United States Patent [19]

Farina et al.

[11] Patent Number: 4,805,590

[45] Date of Patent: Feb. 21, 1989

[54] GAS SPACE HEATING UNIT

[76] Inventors: Alfred J. Farina, 1939 Anita Rd., Baldwin, N.Y. 11510; Laurence B. Craig, 116 Duck Pond Rd., Glen Cove, N.Y. 11542

[21] Appl. No.: 677,538

[22] Filed: Dec. 3, 1984

Related U.S. Application Data

[63] Continuation of Ser. No. 496,196, May 19, 1983, abandoned.

[51] Int. Cl.[4] ..... F24D 9/00

[52] U.S. Cl. ..... 126/101; 126/110 R

[58] Field of Search ..... 126/85 R, 91 R, 91 A, 126/92 AC, 92 B, 92 C, 101, 110 R, 132, 364, 365, 366; 431/328, 347; 122/20 B, 33; 237/8 R, 19, 55; 165/DIG. 2, DIG. 12

[56] References Cited

U.S. PATENT DOCUMENTS

| | | | |
|---|---|---|---|
| 3,217,701 | 11/1965 | Weiss | 126/92 B |
| 4,090,492 | 5/1978 | Simmons | 126/101 |
| 4,143,816 | 3/1979 | Skadeland | 126/132 X |
| 4,147,301 | 4/1979 | Halma et al. | 126/101 X |
| 4,153,199 | 5/1979 | Ellmer | 126/101 X |
| 4,222,350 | 9/1980 | Pompei et al. | 122/33 X |
| 4,261,326 | 4/1981 | Ihlenfield | 126/110 R |
| 4,292,950 | 10/1981 | Schossow | 126/85 B |
| 4,310,746 | 1/1982 | Elkern et al. | 126/101 |

FOREIGN PATENT DOCUMENTS

| | | | |
|---|---|---|---|
| 1129404 | 8/1982 | Canada | 126/101 |

*Primary Examiner*—Margaret A. Focarino
*Attorney, Agent, or Firm*—Myron Amer

[57] ABSTRACT

The use of an incandescing burner or so-called reactor to preliminarily heat water which subsequently is passed in heat exchange with air that is used for spaced conditioning, and wherein the same reactor, which is efficiently operated on a gas-air mixture, is also used to supply hot water.

1 Claim, 1 Drawing Sheet

GAS SPACE HEATING UNIT

Figures 1, 2:
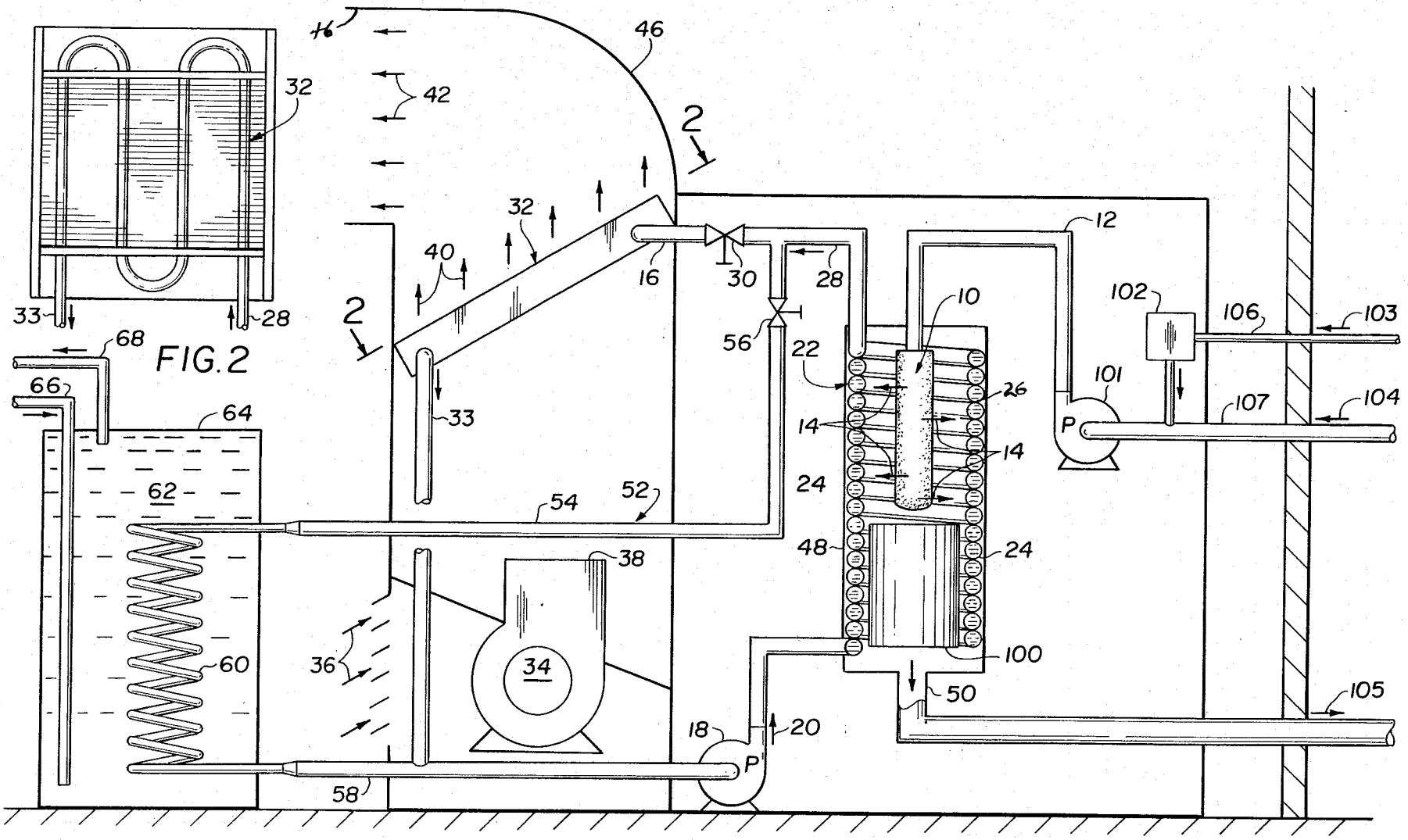

This is a continuation of application Ser. No. 496,196, filed May 19, 1983 for "GAS SPACE HEATING UNIT", now abandoned.

The present invention relates generally to space and water heating units, and more particularly to the advantageous use of a radiant burner or reactor, of the type operated by a gas-air mixture, to provide heat and hot water requirements.

To raise the interior of a dwelling to a comfortable temperature, it is the practice to operate burners on a gas-air mixture as a source of heat, and to pass the air entering the dwelling in heat exchange with the burners, all as is noted in U.S. Pat. No. 4,261,326. The efficiency of this prior art system is determined primarily by the efficiency of the "gas burners", which is not particularly noteworthy. Using the same fuel, namely a gas-air mixture, but not in combustion process involving an "open" flame of a burner or the like, it has been found possible to greatly increase the efficiency of heat exchange to the air delivered for heating purposes, as well as satisfying the hot water needs thereof, and providing many other noteworthy benefits.

Broadly, it is an object of the present invention to provide an efficiently operating gas space heater overcoming the foregoing and other shortcomings of the prior art. Specifically, it is an object to avoid the inefficiency of a gas-fed burner having an open flame as the heat source, and instead use a gas-fueled radiant heater, as exemplified by the heater of U.S. Pat. No. 3,217,701. To achieve this improvement, the heater is first used to heat water which then heats the air, and despite this two-stage heat exchange the efficiency of the within space heater is still a noteworthy improvement over space heaters using open flame burners.

A gas space heating unit for a dwelling or the like demonstrating objects and advantages of the present invention includes three major components consisting of the referred-to radiant burner in the specific form of a cylindrically shaped gas combustion device, an air blower, and a closed conduit loop for flowing water for heat exchange therethrough. Added to the foregoing is a first coiled length segment in said closed loop conduit disposed in encircling relation about the cylindrical gas combustion device for transferring the heat thereof to the flowing water. A second coiled length segment in said conduit is located downstream of the first coiled segment and is disposed in the path of air issuing from the air blower. In this way, there is heat transfer from the previously heated water to the air exiting from the blower incident to the air entering into the dwelling space.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a diagrammatic side elevational view of an improved gas space heating unit according to the present invention; and FIG. 2 is a partial plan view of the air heating portion of the unit of FIG. 1.

PRIOR ART

It is already well known, as exemplified by U.S. Pat. No. 3,217,701, issued on Nov. 16, 1965, for "Radiant Heater", and which patent is herewith incorporated by reference in its entirety, that an optimum source of heat that can be used in heat exchange with a flowing fluid, such as water or the like, to heat a dwelling house or other structure is a so-called combustion element which is described in detail and illustrated in the referred-to patent. More particularly, as noted in column 1, lines 9–20 of said referred-to patent, there is considerable patent literature which discloses techniques for manufacture and use of a porous combustion element. Thus, subsequently in said referred-to patent, as at column 4, lines 7–15, it is noted that an optimum source of heat consists of said porous combustion element that in practice is operated by a combustible gas which is forced under pressure through the porous wall of said element. As a result, the outer surface of the element will sustain a combustion reaction at or adjacent the outer peripheral surface layer thereof, such as will cause the outer surface layer to incandesce.

Also noted in said U.S. Pat. No. 3,217,701, as at column 4, lines 63–67, is that in the operation of the referred-to combustion-operated combustion element, that there is an output therefrom in the form of hot exhaust gases possessing suitable energy in the form of convection heat, and also in the form of direct heat radiation radiating from the incandescent outer surface layer of the combustion element.

INVENTIVE COMBINATION

With the above understanding, it is the inventive contribution hereof to provide a highly efficient gas-fuel space heating unit using the combustion element of the referred-to U.S. Pat. No. 3,217,701. More particularly, and referred to FIG. 1, the combustion element of U.S. Pat. No. 3,217,701 is used in the within inventive combination and is designated 10 and will be understood to be in communication with a source of combustible gas-air, as denoted by the arrow 12 which is forced under pressure into the combustion element 10 and through the porosity of its wall construction so that it radiates radially therefrom as noted by the arrows individually and collectively designated 14.

As understood and as described in detail in the referred-to U.S. Pat. No. 3,217,701, the operation of the combustion element 10 contemplates igniting of the combustion gases 12 with the result that at, or near, the periphery of the surface of the element 10, there is the referred-to combustion reaction that is manifested by incandescence. As a result, the radially flowing exhaust gases 14 are at an elevated temperature with which it is highly desirable to effectuate a heat transfer to any fluid in the vicinity. Additionally, the heat generated by the incandescing surface of the device 10 is an effective radiation heat source for any heat transfer to fluid and/or heat exchange surface in the vicinity.

In accordance with the present invention, there is therefore provided a closed conduit loop, generally designated 16, through which water is circulated by a pump 18. In the direction of the flow induced by the pump 18, namely, direction 20, the closed loop 16 has a first coil length segment, generally designated 22, which consists of helical coils, individually and collectively designated 24, which, as clearly illustrated in FIG. 1, are arranged juxtaposed to each other, as at the point of contact individually and collectively designated 26, and are in superposed relation along the longitudinal axis of the cylindrically shaped combustion device 10. As a result, the water that is circulated through the coil 22 is in heat exchange for the entire length of the combustion device 10 as it flows through the helical coils 24 of which the coil 22 is composed.

More particularly, the hot gas that emanates from reactor 10 passes through and around all of the helical turns 24 of the coil 22. These hot gases transfer their remaining heat by convection and are in contact with the coil 22 due to a turbulent flow pattern that is essentially a helical movement caused by the shape of the coil 22 and the extended surface affixed to it. A plug 100 located centrally at the bottom of the coil 22 contributes to the turbulent flow and forces the combustion gases to flow around the remaining bottom turns 24 of the coil 22, thus extracting an optimum amount of heat therefrom. The cooled combustion gas products and condensate exit the coil chamber 48 through a sealed gas vent conduit 50. It has been found in practice that no secondary heat exchanger is necessary to condense the flue products to obtain a high heat exchange efficiency.

The water which exits from the heat exchange coil 22, as through the exiting length segment 28, will be understood to flow through an open valve 30 and then along an undulating path, provided by a second encountered heat exchange coil 32, the undulating pattern of which is best illustrated in FIG. 2.

The purpose of flowing the previously heated water through the heat exchange coil 32 will soon be explained, but first it is to be noted that said water returns through a return conduit 33 to the inlet of the pump 18 for recirculation. Situated beneath the heat exchange coil 32 is an air blower 34 of conventional construction and a well understood operational mode in which cool air 36 from the dwelling or the like, is drawn into the blower 34 and driven, under pressure, out of the exit end 38 thereof, as in the direction 40. In accordance with the present invention, situated in the path of the exiting air 40 is the second heat exchange coil 32. As a result, the exiting air 40 is passed in heat exchange with the previously heated water circulating through the heat exchange coil 32, with the result that the temperature of the air is elevated and exits as heated air, exemplified by the arrows 42, from the exit opening 44 of a housing 46 which encloses the individual components of the combination structure previously described.

For completeness' sake it is noted that externally disposed about the heat exchange coil 22 is an insulated sealed jacket 48 which by confining the hot exhaust gases to the proximity of the coil 22, enhances the heat exchange which occurs between combustion device 10 and the water circulating through coil 22. Further, and in conjunction with the above, and gas/air supply 12 for the burner 10 is provided by the blower 101.

More particularly, blower 101 obtains air for combustion from a sealed conduit 104 in communication with the outdoors. The gas for combustion is supplied via a sealed conduit 103 from a source that is also outdoors through a combination pressure regulator and shutoff valve 102.

As already noted, the cooled spent combustion exhaust products and condensate are directed through the sealed conduit 50. The exit end of said conduit 50 is also discharged outdoors, as at 105, and thus the within heating unit is one that is completely sealed and rendered safe from leaking any noxious or toxic gases into the living space serviced by said heating unit.

In addition to functioning as the heat source for air being circulated throughout a dwelling or the like, combustion devive 10 also effectively serves as a heat source for hot water service of the dwelling. To this end, there is a second closed loop of conduit, generally designated 52, formed by a length segment 54 starting just upstream of the valve 30 and itself including a check valve 56. The return of the closed loop 52 is provided by a conduit length segment 58, and connected between the two length segments, namely 54 and 58, is a heat exchange coil 60 which it will be understood is immersed in hot water 62 for the dwelling which is stored in a tank 64. Water volume 62 is replenished by cold water through an inlet 66 and is withdrawn under pressure through an outlet 68. Assuming that valve 56 is open, the previously heated water exiting from the coil 22, or at least a portion thereof, is diverted through the length segment 54 and through the heat exchange coil 60 before it returns to the pump 18 through the return conduit 58. While circulating through the heat exchange coil 60, the heated water is effective in elevating the temperature of the water 62 in the tank 64, and in this manner provides hot water service for the dwelling or the like which is operatively associated with the combination heater 10 and blower 34, previously described.

In summary, combustion element 10 is thus effective in supplying the needs for heated air and heated water in a compact, efficiently operating combination of components as hereinbefore described.

A latitude of modification, change and substitution is intended in the foregoing disclosure, and in some instances, some features of the invention will be employed without a corresponding use of other features. Accordingly, it is appropriate that the appended claims be considered broadly and in a manner consistent with the spirit and scope of the invention herein.

What is claimed is:

1. In a gas space heating unit for a dwelling or the like comprising, in combination, a heat exchanger consisting of a porous elongated-shaped gas combustion device operatively arranged to provide an incandescing surface and a source of hot combustion gases eminating radially therefrom and along the length of said elongated shape, a source of water for use in heat exchange with said hot combustion gases, a combination cylindrical housing having an exit opening at one end and a first helical coil disposed in a clearance position in surrounding relation to and along said elongated-shaped combustion device and connected to said source of water for the flowing through said first helical coil of said water incident to establishing said heat exchange between said combustion gases and said water, a plug located at the end of said cylindrical housing to block the flow of combustion gases centrally therethrough directly to said exit opening of said cylindrical housing so as to assist in producing gas movement radially outwardly therefrom into contact with said first helical coil, and pressure means urging a gas and air mixture to said surface of said combination device for supporting said incandescence thereon and also causing the production of hot gas from said mixture and the movement of said hot gas through said porosity thereof and radially outwardly from said elongated-shaped combustion device into heat exchange contact with said first helical coil for enhancing the transfer of heat from said said incandescing surface and said resulting hot gas to said flowing water through said first helical coil, a dwelling space to be heated by hot air having an inlet thereinto and an exist therefrom, an air blower having an inlet in communication with said dwelling space exit for removing cool air therefrom and operatively effective to cause said cool air to issue under pressure from an outlet thereof for flow along a path having communication with said dwelling space inlet, and a closed conduit loop for flowing said heated water for subsequent heat exchange service, said closed conduit loop having said first helical coil therein and a second coil therein located downstream of said first helical coil and disposed in the path of air issuing from said air blower, whereby there is heat transfer from said previously heated water to said exiting from said blower incident to the air entering into said dwelling space.

* * * * *